United States Patent [19]

Murray

[11] Patent Number: 4,928,770

[45] **Date of Patent: * May 29, 1990**

[54] MECHANICAL MANIPULATION TOOL WITH HYDRAULIC HAMMER

[75] Inventor: Douglas J. Murray, Tulsa, Okla.

[73] Assignee: Baker Hughes Incorporated, Houston, Tex.

[ * ] Notice: The portion of the term of this patent subsequent to May 29, 2007 has been disclaimed.

[21] Appl. No.: 308,884

[22] Filed: Feb. 9, 1989

[51] Int. Cl.[5] ..... E21B 4/14

[52] U.S. Cl. ..... 166/385; 166/178

[58] Field of Search ..... 166/178, 373, 385, 386, 166/73, 332, 334

[56] References Cited

U.S. PATENT DOCUMENTS

| | | | |
|---|---|---|---|
| 3,768,562 | 10/1973 | Baker | 166/289 |
| 4,124,070 | 11/1978 | King et al. | 166/255 |
| 4,566,546 | 1/1986 | Evans | 166/178 X |
| 4,573,536 | 3/1986 | Lawrence | 166/373 |

*Primary Examiner*—William P. Neuder

[57] ABSTRACT

A method and apparatus are provided for introduction into a subterranean well on a continuous length of remedial tubing which is concentrically insertable through production tubing previously positioned within the well, the production tubing carrying at least one longitudinally manipulatable member. The apparatus comprises a cylindrical tubular housing having a fluid passageway therethrough communicable with the interior of the remedial tubing for transmission of fluid from within the remedial tubing, through the apparatus, and within an auxiliary apparatus carryable within the well by the remedial tubing, and positionable in the well in proximity to one of the longitudinally manipulatable members. The apparatus also comprises means selectively co-engagable with the longitudinally manipulatable member for moving the manipulatable member to manipulated position. Hammer means are positionable on the apparatus above the selectively co-engagable means and sealingly engagable around the interior of the longitudinally manipulatable member to prevent transmission thereacross of fluid in an annular area between the exterior of the apparatus and the interior of the longitudinally manipulatable member, to the top of the well. The apparatus is activated to move the longitudinally manipulatable member to manipulated position by either hydraulic and/or mechanical tubing manipulating force.

4 Claims, 4 Drawing Sheets

MECHANICAL MANIPULATION TOOL WITH HYDRAULIC HAMMER

BACKGROUND OF THE INVENTION

1. Field of the Invention

The invention relates to a method and apparatus for introduction into a subterranean well on continuous remedial tubing for activating a longitudinally manipulatable member, such as a sliding sleeve, positioned on another conduit, such as production tubing, wherein the apparatus is intended to be primarily activated by manipulation of the remedial tubing to move the manipulatable member to manipulated position, with hydraulic hammer means being provided to provide hydraulic assistance in manipulating the longitudinally manipulatable member.

2. Description of the Prior Art

In the past, those skilled in the art relating to remedial operations associated with the drilling, production and completion of subterranean oil and gas wells have relied on conventional "snubbing" or hydraulic workover units which utilize threaded or coupled remedial tubing normally inserted through production tubing for use in operations, such as perforating, acidizing and fracturing, corrosion control, pressure testing of tubular goods and vessels, cementing, clean out operations, sand bridge removal, storm valve recovery, insertion of kill strings, wireline tool fishing, and the like.

Continuous coiled remedial tubing and injectors for use therewith have contributed substantially to conventional remedial tubing operations. For example, coil tubing, being continuous, can be inserted into the well faster than threaded and coupled tubing which is furnished in relatively short sections that must be screwed together. In addition, it is easier, when required, to pass continuous tubing through stuffing boxes and blowout preventers because its external diameter is consistently the same size and not interrupted periodically by couplings. The coiled remedial tubing normally is made of steel and is commercially available in sizes from 0.75 inch o.d. through 1.315 inch o.d., but may have a smaller or larger diameter. Typical of such remedial coil tubing and injectors is that generally described in U.S. Pat. No. 3,182,877. The apparatus is commercially referred to as the "Bowen Continuous Spring Tubing Injector Unit" and basically comprises a hydraulically powered injector unit which feeds a continuous remedial tubing string from a coiled or "spooled" workstring contained on a powered and generally portable reel unit into the wellhead by means of two opposed, endless, rotating traction members. Such a reel unit is generally described in U.S. Pat. No. 3,614,019. The upper end of the string which remains on the reel is conventionally connected to the hollow shaft of the reel which permits a liquid or a gas to be pumped through the coiled remedial tubing string by means of a swivel connection. The injector and reel are normally mounted on a single transportable skid, a trailer, or, alternatively, may be componently arranged on skids to facilitate convenient offshore use.

To inject remedial coiled tubing, the injector is arranged on or above the wellhead. The reel unit, containing up to approximately 15,000 feet of continuous coiled metal remedial tubing, is located preferably about 15 to 20 feet from the wellhead. The remedial coiled tubing is brought from the reel in a smooth arc loop through the injector unit and into the well through pressure retention and control equipment.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation. Most production formations have a substantial horizontal portions and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be redrilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear wellbore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

In such deviated wellbores, particularly those having the longer lengths, it is difficult, if not impossible, to activate completion equipment, such as shifting tools for opening and closing sleeves, activating wash tools, and the like, by means of conventional electric or piano wireline means, which are disposed through the production tubing which, in turn, has been implaced within the well section through casing (assuming that the well is encased), or, alternatively, through open hole (if the well is not so encased).

As the well section becomes more deviated, the weight suspended from the wireline will become insufficient to actuate the tool, or, at least, to properly position it at the desired location within the deviated portion of the well. Such tools can thus be expected to become improperly lodged or unpositionable within such well. Accordingly, remedial continuous coiled tubing can be utilized to perform operations in such wells heretofore practiced by application of wireline actuated devices.

During acidizing, fracturing, or other completion operations wherein it is desirable to circulate a treating fluid for contact with the production zone, or other areas within the well, it has been known to provide a length of such production tubing with a ported member which has a series of radially extending ports provided within the housing which are selectively closed to prevent fluid flow between the interior and the exterior by means of what is commonly referred to as a "sliding sleeve", which is a member which is implaced within the interior of the device in proximity to the ports, and which is shifted by means of an auxiliary device between open and closed positions. At such time as it is desirable to inject the treating or other fluid into the annulus between the production tubing and the casing (or the open well, in the case of uncased wells), the sleeve is shifted to open the ports for fluid communication between the interior of the production tubing the exterior, or annular area, as defined. Sometimes, such sliding sleeve is manipulated by a device which is carried into the well on wireline, such as electric or piano wire. However, in instances in which such sliding sleeve is positioned within a substantially horizontal section of a subterranean well during the horizontal completion of the well, it will become difficult, if not impossible, to manipulate the sleeve by such means, because the shifting means will either become stuck in the well prior to coming into proximity with the sleeve, or, if properly located, cannot be activated where the shifting device requires application of set down weight to shift the sleeve in a direction to move it to an opening or closing position.

The present invention overcomes such deficiencies by providing a device which is carryable into the well upon continuous remedial tubing, described above, and which utilizes longitudinal manipulation of the remedial tubing as the primary power for activating a longitudinally manipulatable member, such as a sliding sleeve in a ported member. As a backup, or as a combination power source, the apparatus of the present invention also provides hydraulic hammer means, whereby increased hydraulic fluid pressure within an annular area exterior of the remedial tubing but interior of the production tubing and above the apparatus may be utilized to assist longitudinal manipulation of the remedial tubing to drive the apparatus to manipulate the maniputable member, such as the shifting sleeve, or to serve as an auxiliary source for manipulation of said apparatus. Such is desirable, particularly in horizontally completed wells, because longitudinal manipulation of tubing may not be possible due to curvatures in the well, differential sticking, sanding up of moving parts in the apparatus and in the sliding sleeve, and the like.

SUMMARY OF THE INVENTION

The present invention provides an apparatus for introduction into a subterranean well on a continuous length of remedial tubing concentrically insertable through the production tubing previously positioned within the well. The production tubing carries a longitudinally manipulatable member, such as a sliding sleeve which is maneuverable across a ported member for selective transmission of fluids between the exterior and the interior of the production tubing. The apparatus comprises a cylindrical tubular housing having a fluid passageway which is communicable with the interior of the remedial tubing for transmission of fluid from within the remedial tubing, through the apparatus, and within an auxiliary apparatus which is carryable within the well by the remedial tubing and positionable in the well in proximity to one of the longitudinally manipulatable members. Means are provided which are selectively co-engagable with the manipulatable member for moving the manipulatable member to manipulated position. Hammer means are positioned on said apparatus above said selectively co-engagable means and sealingly engagable around the interior of said longitudinally manipulatable member to prevent the transmission thereacross of fluid in an annular area between the exterior of the apparatus and the interior of the longitudinally manipulatable member.

DESCRIPTION OF THE PREFERRED EMBODIMENTS

The present apparatus includes hammer means which are utilized in, for example a shifting tool for either opening or closing a sliding sleeve of a ported member carried on the production tubing. It will be appreciated that the hammer means can also be utilized on a selectively shifting tool which either opens and/or closes such sliding sleeve, or on any remedial tubing tool in which it is desired to have available as a first power source the longitudinal movement of the remedial tubing and as a second power source hydraulic pressure in an annular area exterior of the remedial tubing and interior of the production tubing, with the first and second power sources also being able to be utilized simultaneously, with the hydraulic power source acting as a "booster". In such manner, the remedial tubing may be longitudinally manipulated in one direction, i.e., downwardly or vertically, while hydraulic pressure on the hammer means is incrementally applied in hydraulic pulses to "hammer" the manipulatable means to manipulated position or, alternatively, the hydraulic pressure may be continuously applied in concert with longitudinal manipulation of the remedial tubing to "boost", continuously, the primary power source to drive the longitudinally manipulatable member into manipulated position.

Figure 1:
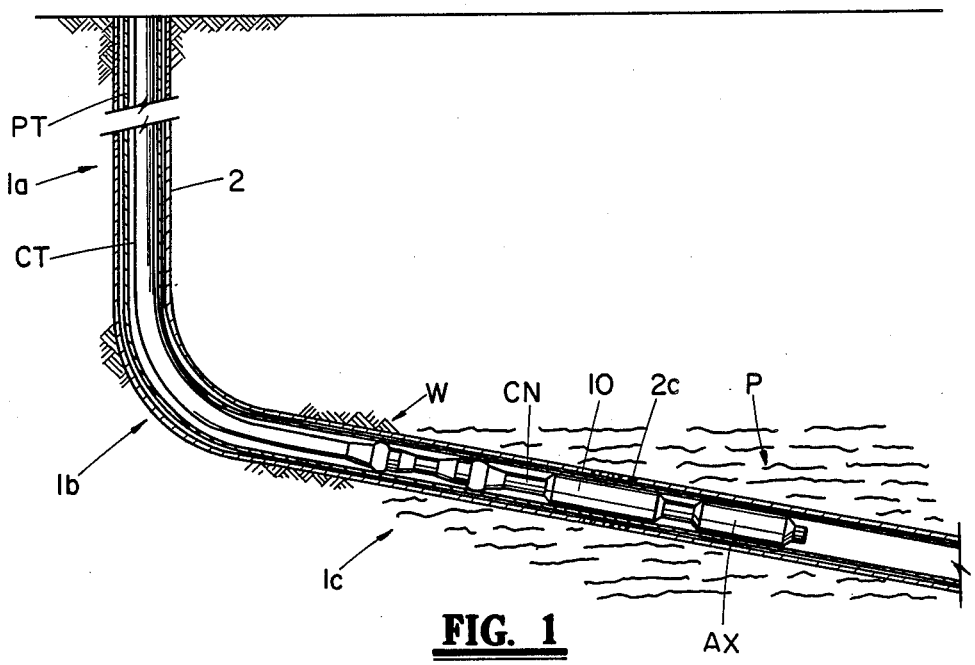
FIG. 1 is a schematic sectional illustration of a horinzontal completion of a subterranean well with the device of the present invention inserted through production tubing and carried on remedial tubing.
Figure 6:
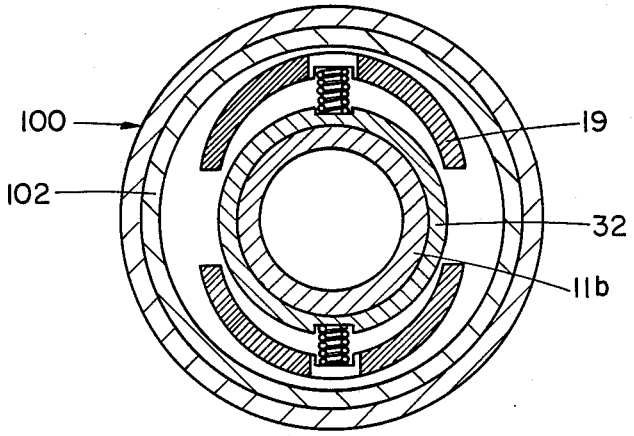
FIG. 6 is a cross-sectional view taken along line 6—6 of FIG. 2.

Now with reference to FIG. 1, there is shown a deviated wellbore W of the type for which this invention is particularly useful. Such wellbore W comprises a vertical entry section 1a communicating through a relatively short radius curvature portion 1b with a non-vertical or horizontal portion 1c communicating with a production formation P. In most instances, the production formation P extends for a substantial horizontal extent and the generally linear wellbore portion 1c traverses a substantial horizontal extent of the production formation P, at least up to a distance of 1000 to 2000 feet or more.

The radius portion 1b of the wellbore W has a curvature of at least 10° per 100 feet of length and preferably a curvature lying the range of 10° to 30° per 100 feet of length. While not limited thereto, each of the modifications of this invention will be described in connection with a casing 2 having been previously inserted in the wellbore and perforated as shown at 2c, although this is not necessary, particularly in the curved portions 1b and the linear non-vertical or horizontal portions 1c traversing the production formation P.

The embodiments of this invention may also be utilized in a well which has not been encased, and which is therefore considered to be an "open hole" completion.

As shown in FIG. 1, the production tubing PT is implaced within the casing C and coiled tubing CT has been inserted from the top of the well carrying an apparatus 10 of th present invention which is affixed to the coiled tubing CT by connector CN, the connector CN being shown and described in U.S. application Ser. No. 308,887, entitled "METHOD AND APPARATUS FOR SECURING AND RELEASING CONTINUOUS TUBING IN A SUBTERRANEAN WELL, and filed on the same date as this application, the assignee of said application being the same as the present application.

An auxiliary tool AX, which may be a wash tool, or other known device, is carried on the coiled tubing CT into the well W and positioned somewhat below the apparatus 10.

Figure 3:
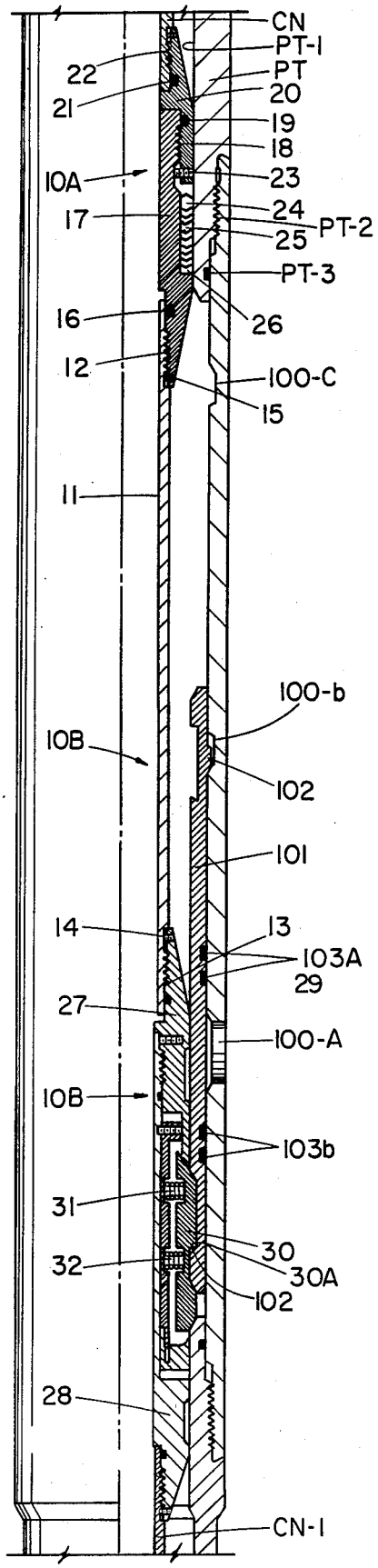
FIG. 3 is a view similar to that of FIG. 2, but showing the apparatus in position subsequent to moving the opening and closing means of the ported member in the closing direction.
Figure 2:
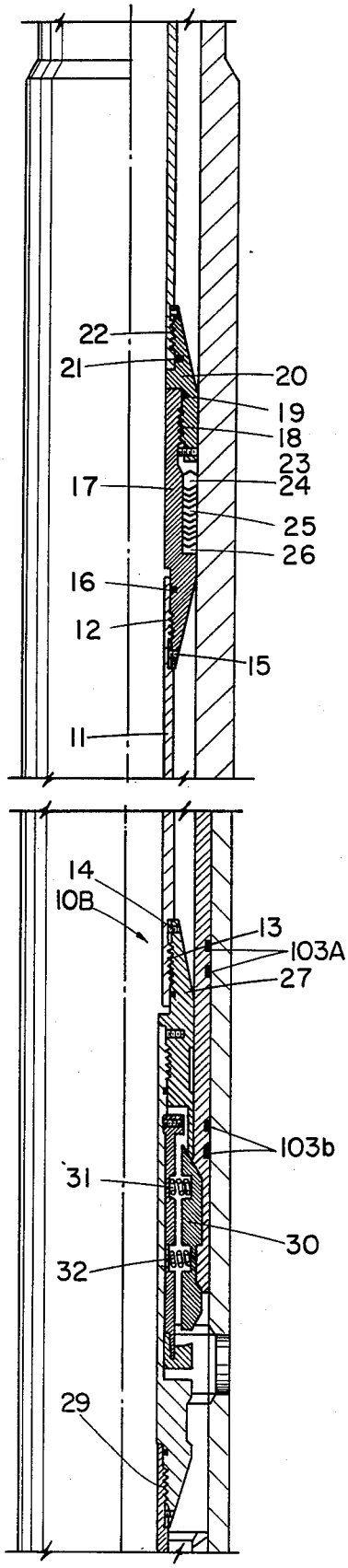
FIG. 2 is a longitudinal sectional drawing showing the apparatus carried into the well on remedial continuous tubing and in position prior to being activated to close the ported member.

Now with reference to FIGS. 2 and 3, there is shown the hydraulic hammer 10a and the shifting apparatus 10b of the present invention. The hammer 10a has an upper housing member 20 which is secured by threads 22 to a connector CN thereabove which, in turn, is secured to coiled tubing CT (not shown). An elastomeric O-ring seal element 21 is positioned within a groove on the housing 20 to prevent fluid communication between the housing 20 and the connector CN.

The housing 20 is, in turn, secured to a lowerr housing element 17 therebelow which is secured by means of threads 18 to the housing 20. An elastomeric O-ring seal element 19 is positioned within the member 20 to prevent fluid communication between the members 17, 20. A set screw 23 prevents rotational movement between the members 17, 20, and assist in securement thereby. Formed within a circumferentially extending smooth bore 26 around the exterior of the housing 17 is a series of chevron-shaped seal elements 25 having upper seal retainer 24 thereon. When placed within the well W and positioned for activation, the seal assembly 25 will have its outer surface in smooth sealing engagement with the internal diameter PT-1 of the production tubing PT thereabove. As shown in the drawings, the production tubing PT is secured by means of threads PT-2 with O-ring PT-3 therebelow to a ported member 100 having port 100a therethrough to permit fluid communication for acidizing, or otherwise treating the well production P. The ported member 100 carries interiorly therearound a longitudinally extending shifting sleeve 101 having a series of circumferentially extending seal elements 103a and 103b which, when the sleeve 101 is positioned as shown in FIG. 3 to close the port 100a, will bridge such port 100a to prevent fluid communication from the exterior of the ported member 100 to the interior of the sleeve 101.

The hammer element 10a is secured by means of a connecting tubular section 11 to the shifting device 10b therebelow by means of threads 13 and set screw 14. The shifting device 10b has a upper housing member 27 and a longitudinally extending lower housing element 28. A shifting dog assembly 30 is carried thereon and is urged outwardly by means of biasing spring members 31, 32. The shifting dog assembly 30 has a functioning longitudinal shoulder 30a for companion shifting engagement onto a shoulder 102 of the sleeve 101.

When it is desired to move the sleeve 101 from the open position in FIG. 2 to the closed position in FIG. 3, the coiled tubing CT is run into the well until such time as the sleeve 101 is located, by known means, such as depth calculation, and the like. Normally, the shifting dogs 30 will come into contact with the companion groove on the sleeve 101 and will be urged there into by means of the springs 31, 32 until the interengagement of the shoulders 30a on the shifting dogs and 102 on the sleeve 101. Now, the coiled tubing CT may be moved longitudinally downwardly to move the locking abuttment 102 on the sleeve 101 from the locked open position by means of interengagement with the companion groove 100c and into the locked closed position by placing the member 102 into the groove 100b on the ported housing member 100. In the event that the apparatus 10b may not be longitudinally manipulated by the coiled tubing CT from the position shown in FIG. 2 to the position shown in FIG. 3, or additional boost is required to so shift the sleeve 101, tubing pressure may be applied at the top of the well W through the annular area defined between the exterior of the coiled tubing CT and the interior of the production tubing PT such that the hammer apparatus 10a in effect becomes a piston by means of pressure applied onto the seals 25 as a result of their sealing engagement along the interior of the production tubing PT. This additional "boost" may be applied continuously by increasing the pressure within this annular area or, alternatively, by pulsation by increasing, decreasing, increasing and serially repeating such variation in pressure to cause a pulsation effect to assist in moving the sleeve 101 to the proper position.

Figure 4:
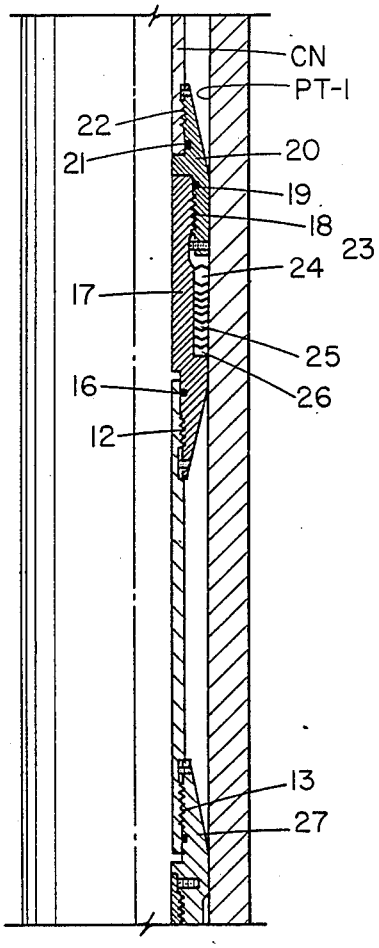
FIGS. 4 and 4A are continuous views similar to those of FIGS. 2 and 3, showing the apparatus in an embodiment whereby two shifting devices are carried on the remedial tubing: one for moving the opening and closing means in the opening direction, and the other for moving the opening and closing means in the other direction, and in position to close the opening and closing means relative to the ported member, with assistance by the hydraulic hammer component.
Figure 4A:
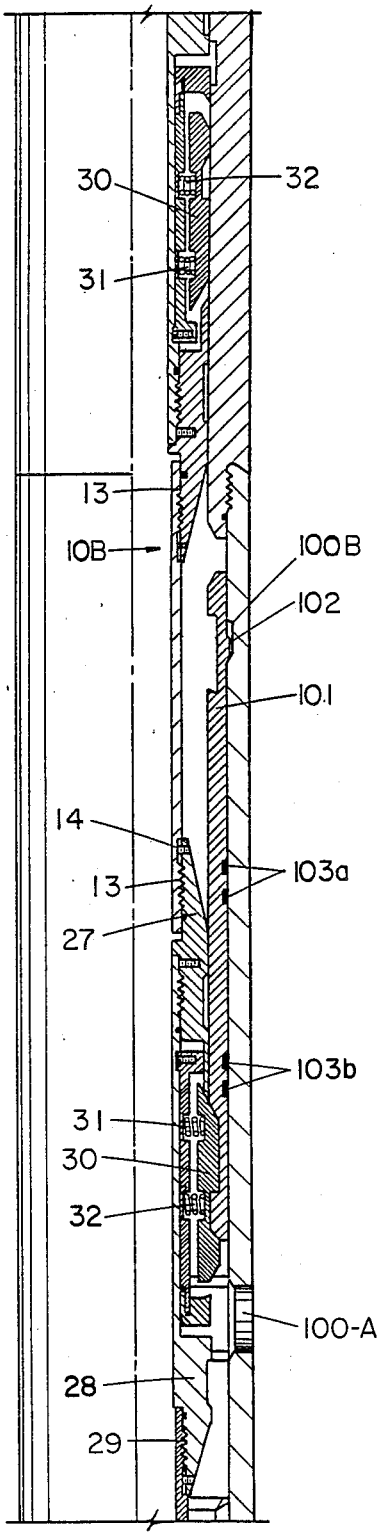
Figure 5:
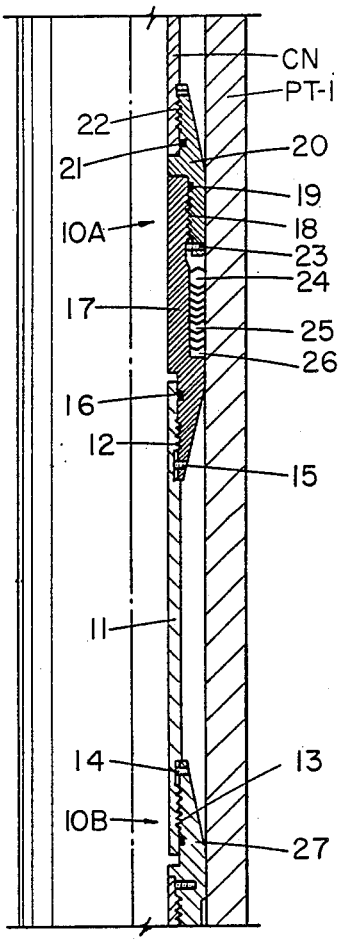
FIGS. 5 and 5A are views similar to those of FIGS. 4 and 4A, illustrating the opening and closing means being moved to the closed position.
Figure 5A:
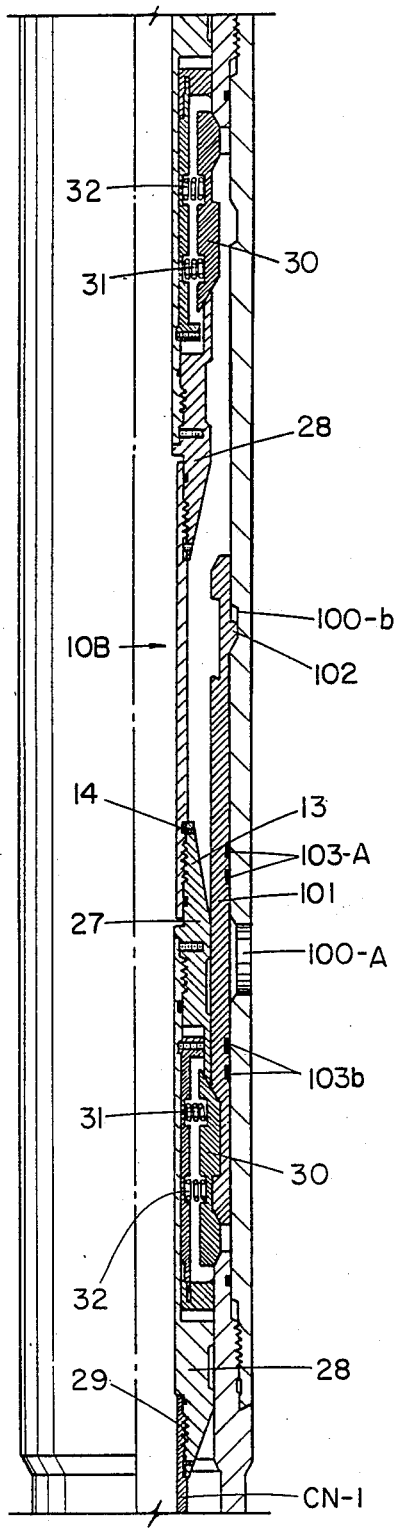

In FIGS. 4 and 4a there is shown a variation of the present invention wherein a plurality of shifting devices 10b are shown in conjunction with the hammer 10a. Such devices 10b may be provided in series on the coiled tubing CT such that one device 10b is provided in the form as shown in FIGS. 2 and 3, and another device is provided by reversing the parts, top to bottom, so that the reversal of the parts permits moving of the sleeve 101 in the opposite direction as shown in FIGS. 2 and 3. In such event, the hammer element 10a is also provided, but will, of course, assist only when it is desired to move the sleeve 101 to a position by means of downward movement of the coiled tubing CT, either mechanically, or by hydraulic means, as described.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for introduction into a subterranean well on a continuous length of remedial tubing concentrically insertable through production tubing previously positioned within said well, said production tubing carrying thereon at least one longitudinally manipulatable member, said apparatus comprising:

(1) a cylindricaly tubular housing having a fluid passageway therethrough communicable with the interior of the remedial tubing for transmission of fluid from within the remedial tubing, through the apparatus, and within an auxiliary apparatus carryable within said well by said remedial tubing, and positionable in said well in proximity to one of said longitudnally manipulatable members;

(2) means selectively co-engagable with said longitudinally manipulatable member for manipulating said manipulatable member in at least one direction upon longitudinal manipulation of said remedial tubing; and (3) hammer means positionable on said apparatus above said selectively co-engagable means and sealingly engagable around the interior of said longitudinally manipulatable member to prevent the transmission thereacross of fluid in an annular area between the exterior of the apparatus and the interior of the longitudinally manipulatable member and extending to the top of the well, whereby an increase of pressure in said fluid in said annular area will be applied to said hammer means to urge the apparatus to longitudinally reposition the manipulatable member.

2. A method for manipulating a longitudinally manipulatable member in a subterranean well, comprising the steps of:

(1) introducing into said well an apparatus on a continuous length of remedial tubing concentrically insertable through production tubing previously positioned within said well, said production tubing carrying thereon at least one longitudinally manipulatable member, said apparatus comprising:

(a) a cylindricaly tubular housing having a fluid passageway therethrough communicable with the interior of the remedial tubing for transmission of fluid from within the remedial tubing, through the apparatus, and within an auxiliary apparatus carryable within said well by said remedial tubing, and positionable in said well in proximity to one of said longitudinally manipulatable members;

(b) means selectively co-engagable with said longitudinally manipulatable member for manipulating said manipulatable member in at least one direction upon longitudinal manipulation of said remedial tubing; and (c) hammer means positionable on said apparatus above said selectively co-engagable means and sealingly enagagable around the interior of said longitudinally manipulatable member to prevent the transmission thereacross of fluid in an annular area between the exterior of the apparatus and the interior of the longitudinally manipulatable member and extending to the top of the well, whereby an increase of pressure on said fluid in said annular area will be applied to said hammer means to urge the apparatus to longitudinally reposition the manipulatable member;

(2) longitudinally manipulating said remedial tubing whereby said manipulating member is in position to move said manipulatable member; and (3) attempting to move said manipulatable member by said manipulating member by moving said remedial tubing to a known position; and (4) simultaneously while performing step 3, applying pressure to fluid in said annular area between the exterior of the apparatus and the interior of the longitudinally manipulatable member to activate said hammer means to urge the manipulatable member into manipulated position.

3. An apparatus for introduction into a subterranean well on a continuous length of remedial tubing concentrically insertable through production tubing previously positioned within said well, said production tubing carrying thereon at least one ported member for selective transmission of fluids between the exterior and interior of the production tubing, each of said ported members receiving means movable in each of opening and closing directions for opening or closing the respective ported member, said apparatus comprising:

(1) a cylindrical tubular housing having a fluid passageway therethrough communicable with the interior of the remedial tubing for transmission of fluid from within the remedial tubing, through the apparatus, and within an auxiliary apparatus carryable within said well by said remedial tubing, and positionable in said well in proximity to one of said ported members;

(2) means selectively co-engageable with said opening and closing means for moving said opening and closing means in only one of opening and closing directions; and (3) hammer means positionable on said apparatus above said selectively co-engagable means and sealingly engagable around the interior of said means movable in each of opening and closing directions to prevent the transmission thereacross of fluid in an annular area between the exterior of the apparatus and the interior of the means movable in each of opening and closing directions, whereby upon an increase of fluid pressure in said annular area said hammer means will urge the means movable in each of opening and closing directions in only one of said opening and closing directions to open or close the respective ported member, alone or in combination with longitudinal manipulation of said remedial tubing.

4. The apparatus of claim 3 wherein said co-engagable means comprises a plurality of inwardly flexible key members circumferentially disposed exteriorly around said apparatus and normally urged outwardly of said apparatus.

* * * * *